United States Patent [19]

Hamilton et al.

[11] 4,341,353

[45] Jul. 27, 1982

[54] METHOD AND APPARATUS FOR RECOVERING FUEL AND OTHER RESOURCES FROM REFUSE UTILIZING DISK SCREENS

[75] Inventors: Frank G. Hamilton, Memphis, Tenn.; John Kelyman, Jr., Warren, Oreg.

[73] Assignee: Rader Companies, Inc., Portland, Oreg.

[21] Appl. No.: 11,427

[22] Filed: Feb. 12, 1979

[51] Int. Cl.[3] ..... B02C 23/14

[52] U.S. Cl. ..... 241/24; 241/76; 241/78; 241/DIG. 38

[58] Field of Search ..... 241/24, 68, 69, 75, 241/76, 77, 78, 79, DIG. 38, 80

[56] References Cited

U.S. PATENT DOCUMENTS

| | | | |
|---|---|---|---|
| 631,093 | 8/1899 | Richards et al. . | |
| 3,524,594 | 8/1970 | Anderson et al. | 241/76 X |
| 3,790,091 | 2/1974 | Law et al. | 241/24 |
| 3,970,546 | 7/1976 | Webb et al. | 241/24 X |
| 4,037,723 | 7/1977 | Wahl et al. | 209/104 |
| 4,098,464 | 7/1978 | Niedner et al. | 241/24 |
| 4,113,185 | 9/1978 | Marsh et al. | 241/24 X |

FOREIGN PATENT DOCUMENTS

| | | |
|---|---|---|
| 1172 | 3/1979 | European Pat. Off. . |
| 448838 | 6/1936 | United Kingdom . |
| 518330 | 2/1940 | United Kingdom . . |
| 1087921 | 10/1967 | United Kingdom . |
| 1177769 | 1/1970 | United Kingdom . |

*Primary Examiner*—Howard N. Goldberg
*Attorney, Agent, or Firm*—Klarquist, Sparkman, Campbell, Leigh, Whinston & Dellett

[57] ABSTRACT

Disk screens having various interface opening dimensions are combined with air classifiers and other refuse separating components to separate municipal and industrial refuse into a fuel fraction and other recyclable resource fractions, each having a low percentage of unwanted materials therein.

15 Claims, 4 Drawing Figures

METHOD AND APPARATUS FOR RECOVERING FUEL AND OTHER RESOURCES FROM REFUSE UTILIZING DISK SCREENS

CROSS-REFERENCES TO RELATED APPLICATIONS

This application relates to a method and apparatus for processing refuse which utilizes disk screens of the type disclosed in U.S. Pat. No. 4,037,723 issued July 26, 1977 and an air classifier of the type disclosed in U.S. application Ser. No. 962,951 filed Nov. 22, 1978.

BACKGROUND OF THE INVENTION

The present invention relates to the processing of refuse, and more particularly to a method and apparatus for recovering fuel and other resources from solid municipal and industrial refuse utilizing disk screens.

In the past solid municipal and industrial refuse has been disposed of by incineration and by using the refuse as landfill. In recent years the problem of refuse disposal has become critical as a result of a rapid increase in population combined with a significant increase in per capita production of waste. Landfill operations have become increasingly undesirable due to the dwindling supply of suitable acreage within a reasonable distance of population centers. This tends to make incineration the preferred alternative. In view of the current energy crisis efforts have been made to utilize refuse as a source of fuel for power plant boilers, as contrasted with merely incinerating the combustible refuse for purposes of physical reduction. In addition, efforts have been made to recover other valuable resources such as glass, aluminum, and ferrous metals so that they can be recycled. An example of one process for recovering fuel and other resources from municipal and industrial refuse is disclosed in U.S. Pat. No. 4,113,185 issued Sept. 12, 1978.

Refuse processing systems heretofore known have typically included a plurality of components for separating the refuse into individual fractions consisting primarily of combustible organic material, aluminum, ferrous metals, glass, and miscellaneous bulky inorganic material. Efficient resource recovery depends upon separating the maximum amount of desirable material from the refuse using relatively few separating components. It also depends upon minimizing the percentage of unwanted materials in the individual fractions. For example, it is desirable to produce a fraction consisting primarily of aluminum and containing very little glass, paper, plastic, dirt, etc. so that the aluminum can be readily recycled. Also the presence of incombustibles such as inorganic materials and the like in the fuel fraction can reduce the BTU content. It will also increase the ash content and necessitate the frequent cleaning of the traveling grate or suspension burning mechanisms of power plant boilers.

Conventional separating components which have been utilized in refuse processing systems in the past include screens, vibrating tables, air classifiers, cyclones, pulpers, and magnetic separators. It has been found that the combination of one or more screens with an air classifier can greatly improve the separating efficiencies of most refuse processing systems. Two basic kinds of screens have been utilized in refuse processing systems in the past. The first kind comprises a vibrating grate having apertures through which suitably sized pieces of refuse pass. The second kind is generally referred to as a trommel screen. It comprises an elongate cylinder having a plurality of apertures through its wall. Refuse is introduced into the interior of the cylinder through one of its open ends and suitably sized pieces of refuse pass through the apertures as the cylinder is rotated.

However both of the aforementioned kinds of screens have a tendency to become partially blinded fairly rapidly when used to separate shredded refuse. Their apertures become partially obstructed with refuse thus inhibiting proper grading or sifting. This in turn reduces the efficiency of the other downstream separating components. For example it has been discovered that a failure to remove a large percentage of ground glass and other fine inorganic materials will reduce the efficiency of a downstream air classifier in separating shredded light organic material from denser inorganic material. Also, the operating efficiency of downstream magnetic separators is reduced if a large percentage of paper and other organic material is not removed ahead of time. Even worse is the fact that both of the aforementioned kinds of screens eventually become totally blinded, i.e. their apertures become completely plugged with refuse. The operation of the processing system must be periodically interrupted so that these screens can be cleaned.

Disk screens having a plurality of interleaved rotating disks have been used to separate particulate material such as pulp chips from wood chunks, frozen lumps, etc. with a high degree of efficiency. They do not have a tendency to become blinded. U.S. Pat. No. 631,093 teaches that the spacing between the disks can be varied according to the quality of material to be separated. U.S. Pat. No. 4,037,723 suggests that disk screens can be used in refuse processing. However, to date a method and apparatus for processing refuse utilizing disk screens has not been developed.

SUMMARY OF THE INVENTION

It is an object of the present invention to provide a method and apparatus for more efficiently recovering fuel and other resources from solid municipal and industrial refuse.

It is another object of the present invention to provide a method and apparatus for processing solid refuse utilizing disk screens.

It is yet another object of the present invention to provide a method and apparatus for separating solid municipal and industrial refuse into individual fractions of desired materials, each fraction having a relatively low percentage of unwanted materials therein.

It is still a further object of the present invention to process shredded refuse through a disk screen in order to remove crushed glass and other fine material so that the remaining refuse can be more efficiently separated into light and heavy fractions in an air classifier.

It is still another object of the present invention to utilize disk screens for separating the heavy fraction discharged from an air classifier into still further fractions of desired materials, each fraction having a relatively low percentage of unwanted materials therein.

It is yet another object of the present invention to provide an apparatus for processing solid refuse which will eliminate costly maintenance and downtime usually associated with conventional screens incorporated in such apparatus.

DESCRIPTION OF THE PREFERRED EMBODIMENTS

One embodiment of the method and apparatus of the present invention will be explained by way of reference to the apparatus shown in FIG. 1. Raw municipal and industrial refuse in solid form is fed into the apparatus at the left and is processed from left to right through a plurality of components which separate the refuse into individual fractions as indicated by the flow lines. The apparatus incorporates a plurality of disk screens 10, 12, 14, 16, 18 and 20. Before describing in detail the operation of the apparatus shown in FIG. 1 the general configuration of the disk screens incorporated therein will be briefly described.

The disk screens (FIG. 2) are preferably constructed in accordance with U.S. Pat. No. 4,037,723, the disclosure of which is specifically incorporated herein by reference. Each disk screen includes a frame which supports a plurality of parallel rows of interleaved disks which are rotated in the same direction. Shredded refuse fed onto the tops of the disks at the infeed end of the disk screen is passed along from one row to the next, the finer refuse (hereafter underflow) dropping through the apertures between adjacent disks, and the coarser refuse (hereafter overflow) being carried along on top of the disks to the discharge end of the disk screen. The disks are preferably toothed or scalloped to facilitate the feeding of larger pieces of refuse lengthwise of the frame while permitting the smaller pieces and fine particles to fall freely between the overlapping disks. If the spacing between adjacent disks increase from the feed end of the disk screen to the discharge end of the disk screen, shredded refuse fed onto the feed end of the disk screen will in effect be graded. Progressively larger pieces of refuse will fall through the apertures between the disks as the refuse is conveyed on top of the disks toward the discharge end of the disk screen.

Figures 1, 2:
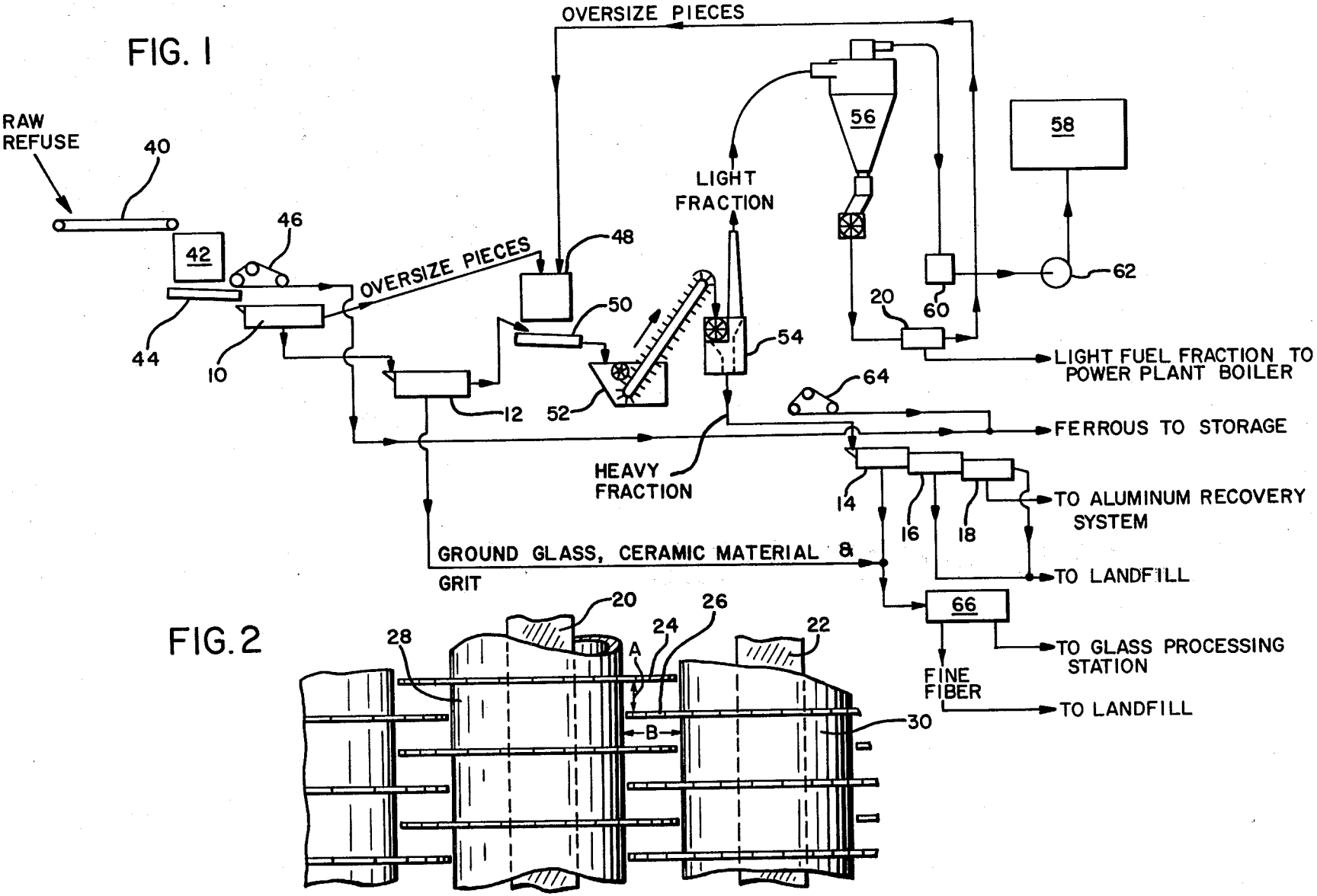
FIG. 1 is a somewhat simplified schematic diagram illustrating one embodiment of the present invention.
FIG. 2 is an enlarged fragmentary horizontal sectional view of one of the disk screens incorporated in the embodiment of FIG. 1.

FIG. 2 illustrates in detail the formation of the apertures in each of the disk screens 10, 12, 14, 16, 18 and 20. Adjacent square tubing shafts 20 and 22 carry interleaved disks 24 and 26. The disks 24 are separated by cylindrical spacers 28 and the disks 26 are separated by cylindrical spacers 30, the spacers having an outer diameter slightly less than the disks. The distance A between adjacent disks 24 and 26 will hereafter be referred to as the interface opening dimension. The distance B between adjacent spacers 28 and 30 will hereafter be referred to as the slot dimension. By preselecting these dimensions for a given disk screen, shredded refuse fed thereon can be separated according to size into an underflow fraction and an overflow fraction. Hereafter, a disk screen with an interface opening dimension of about five-eights of an inch or less will be referred to as a fine disk screen. A disk screen with an interface opening dimension of from about three-quarters of an inch to about two inches will be referred to as a medium disk screen. A disk screen with an interface opening dimension of more than about two inches will be referred to as a course disk screen.

Referring again to FIG. 1, raw solid municipal and industrial refuse is deposited on the infeed end of a conventional belt conveyor 40 in any suitable fashion. For example, truck loads of the refuse may be deposited on a flat receiving surface and pushed by a bulldozer into an open collection hopper (not shown) leading to the infeed end of the conveyor 40. The composition of the raw refuse can vary tremendously depending upon such factors as season and locality. The following list of approximate percentages of components by weight is illustrative of the composition of typical municipal refuse:

| | |
|---|---|
| Paper | 42% |
| Food Waste | 12% |
| Ashes | 10% |
| Metallics | 8% |
| Glass & Ceramics | 6% |
| Leaves | 5% |
| Grass | 4% |
| Sweepings | 3% |
| Wood | 2.4% |
| Brush | 1.5% |
| Greens | 1.5% |
| Rags | 1% |
| Household Dirt | 1% |
| Oil & Paint | .8% |
| Plastic | .7% |
| Rubber | .6% |
| Leather | .3% |
| Linoleum | .1% |
| Unclassified | .1% |
| TOTAL | 100% |

The moisture content of the refuse can vary tremendously. Moisture contents as low as 13% by weight and as high as 53% by weight have been measured. Percentages hereafter given refer to percentage by weight, unless otherwise specified. It will be understood that the percentages hereafter given relating to the separation performed by the various components of the apparatus will vary depending upon the composition and moisture content of the refuse.

Refuse from the discharge end of the conveyor 40 is deposited into a primary shredder 42 where the refuse is reduced to a size suitable for further processing. Various types of shredders, such as hammermills, may be used. Examples of suitable commercially available shredders are the AMERICAN SOLID WASTE SHREDDERS manufactured by American Pulverizer Company, 5540 West Park Avenue, St. Louis, Mo. 63110 and the WILLIAMS SOLID WASTE SHREDDERS manufactured by Williams Patent Cursher and Pulverizer Company, 2701 North Broadway, St. Louis, Mo. 63102. The primary shredder shreds the refuse into pieces of a range of sizes. Preferably a major portion of these pieces have a maximum dimension of four inches or less. Much of the glass contained in the raw refuse is crushed in the primary shredder.

The shredded refuse is discharged from the primary shredder 42 onto a conveyor such as a vibrating pan 44 which conveys the refuse underneath a first magnetic separator 46. One suitable commercially available vibrating pan is manufactured by Rexnord Incorporated, Material Handling Division, Lebenon Road, Danville, Ky., 40422. The first magnetic separator 46 typically extracts from about eighty-seven to about ninety-two percent of the ferrous metal from the shredded refuse. It is desirable to extract a major portion of the ferrous metal in advance of the disk screens to reduce wear on the same. It also reduces the liklihood that the disk screens will jam or become damaged by pieces of iron or steel. Various types of magnetic separators such as the belt or drum types may be used. Examples of suitable commercially available magnetic separators are the DINGS SOLID WASTE MAGNETIC SYSTEM manufactured by the Dings Company, Magnetic Group, 4744 West Electric Avenue, Milwaukie, Wis., 53219 and the ERIEZ HEAVY DUTY MAGNETIC REFUSE DRUM, manufactured by the Eriez Manufacturing Company, Erie, Pa., 16512.

The remaining shredded refuse, now less a major portion of its ferrous metal, is discharged onto a medium disk screen 10 which scalps out oversize pieces of refuse, i.e. its overflow consists of pieces which are too large for use as fuel. The disk screen 10 has an interface opening dimension of approximately one inch and a slot dimension of approximately three and one-quarter inches. The disk screen 10 typically separates about fifty to sixty percent of the refuse fed thereto into underflow and the remainder into overflow. The overflow is discharged into a secondary shredder 48 which re-shreds the same into smaller pieces. Preferably the secondary shredder 48 re-shreds the oversize pieces into pieces which predominantly have a maximum dimension of two inches or less. One of the aforementioned commercially available shredders may be utilized as a secondary shredder.

The combination of a primary and secondary shredder with an intermediate scalping disk screen is desirable for several reasons. Much of the raw refuse will be reduced to pieces having a maximum dimension of less than two inches after only a minimal amount of initial shredding time. The work load on the primary shredder is reduced since it does not have to shred the raw refuse for an extended period of time until all of the refuse is reduced to pieces which are less than or equal to the two inch fuel size. The work load on the secondary shredder is also reduced since it need only re-shred the oversize fraction. Furthermore, if one of the shredders should break down the entire system does not have to shut down since one shredder will still be available, however the operating efficiency of the system will be reduced in such a case. If desired, the secondary shredder 48 can be eliminated and the overflow from the disk screen 10 can be returned by a turntable or other conveyor to the primary shredder for re-shredding.

The underflow from the disk screen 10 is conveyed to a fine disk screen 12 which has an interface opening dimension of approximately three-eighths of an inch and a slot dimension of approximately five-eighths of an inch. The fine disk screen 12 typically separates about twelve to sixteen percent of the refuse received thereby into underflow and the remainder into overflow. The underflow from the disk screen 12 consists primarily of finely ground glass and ceramic material, and other grit. It also contains some fine fiber. The overflow consists of glass fragments and other particles greater than three-eighths of an inch in dimension.

The re-shredded refuse from the secondary shredder 48 and the overflow from the fine disk screen 12 are both discharged into a suitable conveyor such as a second vibrating pan 50. One of the aforementioned commercially available vibrating pans can be utilized. The shredded refuse from the vibrating pan 50 is discharged into a metering bin 52 which is designed to feed a constant volume of shredded refuse to an air classifier 54. Without the metering bin the separating efficiency of the air classifier would be greatly reduced. One suitable commercially available metering bin is manufactured by the Rader Companies, Inc., 6005 Northeast 82nd Avenue, Portland, Oreg., 97220, and is sold as part of their ADS (Registered Trademark) System. It has a steeply inclined belt conveyor having flights. A leveling roll over the conveyor scalps off excess refuse so that a more or less constant quantity of refuse is carried between the flights to the air classifier 54.

Shredded refuse from the metering bin 52 is discharged into the star feeder air lock of the air classifier 54. In the separation zone of the air classifier the shredded refuse is separated into a light fuel fraction consisting primarily of paper, plastic, miscellaneous light fibrous material, rags, wood, etc. and a heavy fraction consisting primarily of heavier inorganic material, e.g. non-ferrous metal, glass chunks, ground up aluminum cans, heavy fiber, rubber, leather, etc. The light fraction typically comprises about eighty to ninety-five percent of the shredded refuse fed to the air classifier 54. The apparatus of FIG. 1 typically separates about seventy-five to eighty-two percent of the total amount of raw refuse into a light fuel fraction. Of course, as previously mentioned these percentages can vary greatly depending upon the composition of the shredded refuse and its moisture content.

It is important to note that the glass fragments which are small enough to pass through the disk screen 10 but are too large to pass through the disk screen 12 bypass the secondary shredder 48 where they would otherwise be further pulverized. Further pulverization of these glass chunks would intermix the glass with the other shredded refuse and lower the glass separating efficiency of the air classifier. Larger glass fragments are more easily separated in an air classifier than finer particles.

A wide variety of air classifiers may be used. However, since precise air control is critical to optimum separation in the air classifier it is preferred to use the air classifier sold as part of the Rader ADS System (previously noted). This air classifier is described in detail in U.S. application Ser. No. 962,951 filed Nov. 22, 1978, the disclosure of which is specifically incorporated herein by reference. It has movable, hinged panels which allow for adjustment in both the size and shape of the air separation zone. Air volume and refuse infeed are held constant and the panels are adjusted to control what portion of the refuse drops and what portion flies. This air classifier also includes a secondary air bleed-in which improves separation efficiency.

The light fuel fraction discharged from the air classifier 54 is conveyed to a cyclone 56 which separates the light fraction from the conveying air expelled from the air classifier. The light fuel fraction drops to the bottom of the cyclone and is discharged therefrom through a star feeder air lock. It is then conveyed to the power plant boiler. The conveying air is discharged from the top of the cyclone 56. It contains a significant quantity of dust and other fine particulate material which is filtered out in a bag house 58. A wide variety of commercially available cyclones are suitable, however it is preferable to use the cyclone sold as part of the Rader ADS System previously mentioned. This cyclone has replaceable liners. The light fuel fraction which descends to the bottom of this cyclone passes through a vortex straightner in the form of a plurality of radially inwardly extending plates. The vortex straightner insures a constant, even, vertical drop of the light fuel fraction. If desired the light fuel fraction from the cyclone 56 may be discharged onto a scalping disk screen 20 which separates out oversize pieces which have not heretofore been removed for re-shredding by the secondary shredder 48. The scalping disk screen 20 has an interface opening dimension of approximately one inch and a slot dimension of approximately three and one-quarter inches. It serves as a final fuel size control.

The conveying air discharged from the cyclone 56 is preferably drawn through a reverse flow trap 60 with the aid of a fan 62. Oversize pieces of refuse which have not heretofore been extracted are removed. The reverse flow trap comprises a large cylinder having an infeed pipe or conduit coupled to its upper end and a laterally extending dust pipe coupled to its side wall. Due to the relatively low velocity of air within the cylinder oversize pieces of refuse settle therein while the dust is carried to the bag house. A screen on the dust pipe prevents oversize pieces of refuse from passing through the dust pipe into the bag house.

The heavy fraction discharged from the air classifier 54 is conveyed underneath a second magnetic separator 64 which extracts substantially all of the remaining ferrous metal. Preferably about ninety-five to ninety-eight percent of the ferrous metal originally contained in the raw refuse has been removed after the second magnetic separator. Commercially available magnetic separators of the aforementioned belt or drum type are suitable for this purpose.

The remaining heavy fraction is now processed through a triple assembly of the disk screens 14, 16 and 18, in sequence. These disk screens have progressively larger apertures. Initially the remaining heavy fraction is fed to the fine disk screen 14 which has an interface opening dimension of approximately three-eighths of an inch and a slot dimension of approximately one and one-eighth inches. This disk screen 14 separates the remaining heavy fraction into an underflow typically consisting of about twenty to thirty percent of the refuse fed thereto. This underflow consists primarily of finely ground glass and ceramic material and other grit which has not been previously removed. This underflow is combined with the underflow of similar composition from the fine disk screen 12 and both are conveyed to a glass processing station (not shown) for recycling to a glass plant. This material may also be used as road aggregate.

If desired the underflow from the disk screens 12 and 14 may be processed through a special separator 66 designed to separate the glass from the fine fiber. One suitable commercially available separator for this purpose is the CONCENTRATOR manufactured by Kipp Kelly, Ltd., 68 Higgin Avenue, Winnipeg, Manitoba, Canada, R3B-0A6. This unit includes a vibrating screen onto which the underflow is discharged. The holes in the screen are too small to permit any of the underflow to pass therethrough. Air is forced upwardly through the holes to separate the fine fiber from the glass.

The overflow from the fine disk screen 14 is discharged onto the medium disk screen 16. It has an interface opening dimension of approximately one and one-half inches and a slot dimension of approximately one and one-half inches. It separates the remaining refuse fed thereto into an underflow typically consisting of about forty to fifty percent of the refuse fed thereto. This underflow consists primarily of poor grade fibrous material and inorganic material. It may be disposed of by using it as landfill or it may be processed through an additional disk screen (not shown) to separate the combustible portion for use as fuel.

The overflow from the medium disk screen 16 is discharged onto the coarse disk screen 18 which has an interface opening dimension of approximately three inches and a slot dimension of approximately three and one-quarter inches. The coarse disk screen 18 separates the remaining refuse into an underflow typically consisting of about seventy to eighty percent of the refuse fed thereto. A large proportion of this underflow consists of partially shredded aluminum cans. The underflow from the disk screen 18 can be conveyed to an aluminum recovery system such as an aluminum magnet (not shown) which will separate a fraction therefrom consisting almost entirely of aluminum cans which can be readily recycled. The overflow from the coarse disk screen 18 consists primarily of large chunks of glass, non-ferrous metal, and other miscellaneous pieces of oversized refuse which have not heretofore been removed. This overflow is disposed of by using it as landfill.

It will be understood that the system of FIG. 1 can be modified in various ways to accommodate specific needs dictated by the composition of the refuse as well as space and capital limitations. The interface opening and slot dimensions of the various disk screens can be adjusted to achieve maximum separating efficiency. This is readily accomplished by changing the sizes of the spacers. The disk screens 14, 16 and 18 could be combined into a single unit. Furthermore, various subcombinations of the system of FIG. 1 could be utilized alone or in combination with other refuse processing systems to improve separating efficiency. For example, the system of FIG. 1 without the disk screens 14, 16 and 18 would still produce a high quality fuel fraction. The use of a fine disk screen for removing finely ground glass and ceramic material from shredded refuse before separating it in an air classifier improves the separating efficiency of the air classifier. The use of a scalping disk screen can improve the overall efficiency of the shredding operation in terms of the size of the shredder or shredders required and the energy consumed by the shredding operation. The combination of an air classifier with fine, medium, and coarse disk screens for separating the heavy fraction discharged from the air classifier results in highly efficient recovery of resources from the heavy fraction.

If the moisture content of the refuse is relatively high it may be desirable in terms of overall energy efficiency to process the shredded refuse through a dryer. This will raise the BTU content of the fuel fraction. It will also improve the separating efficiency of the various components. One suitable commercially available dryer is the SINGLE PASS ROTATING DRUM DRYER manufactured by the Thompson Dehydrating Company, 700 West Laurent, Topeka, Kansas, 66608.

Figure 3:
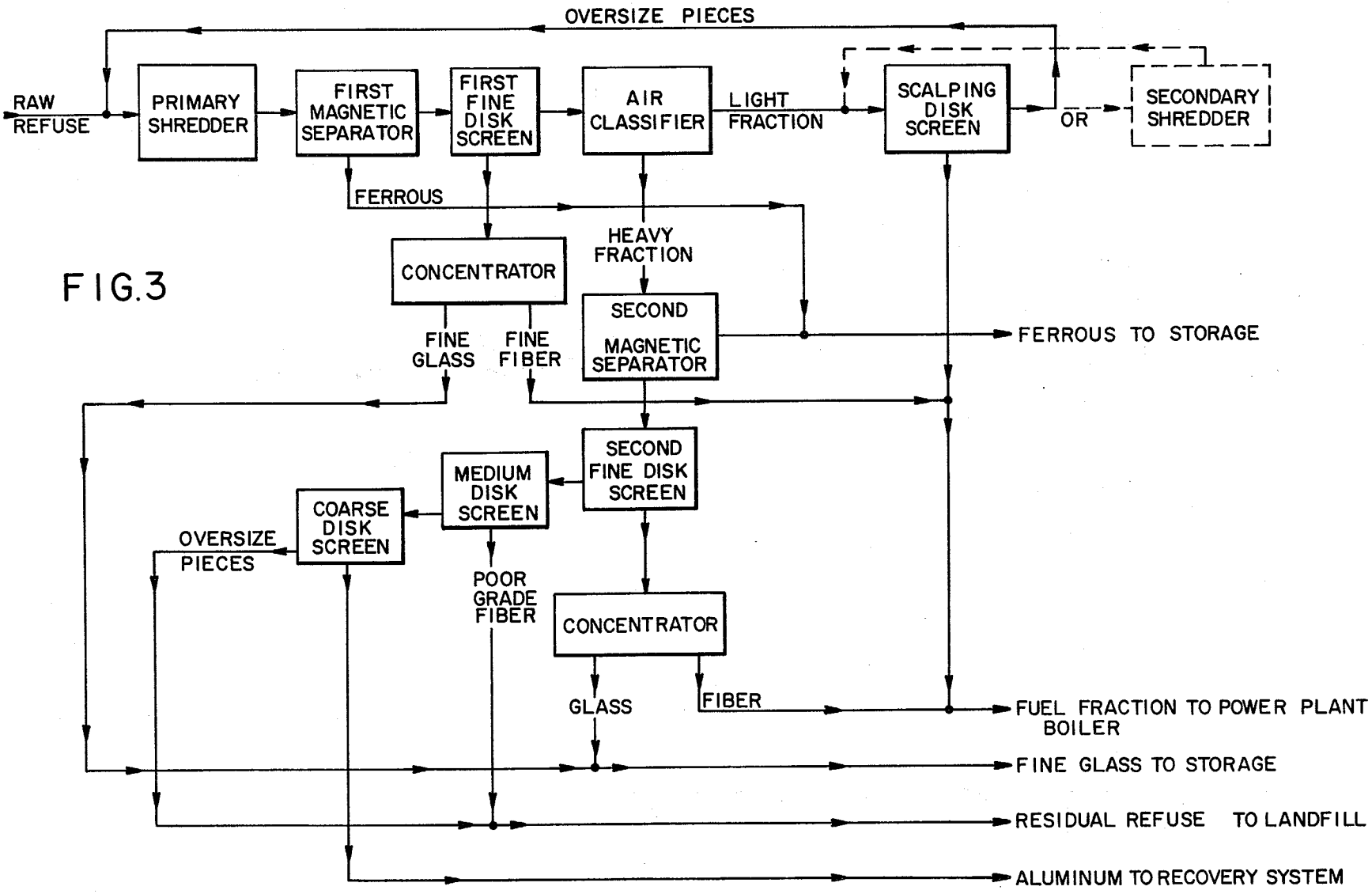
FIG. 3 is a functional block diagram illustrating a second embodiment of the present invention.

The Embodiment of FIG. 3

In the embodiment of FIG. 3 shredded refuse from a primary shredder is conveyed underneath a first magnetic separator and then discharged onto a first fine disk screen. The underflow from the first fine disk screen consists primarily of ground glass and other fine material, e.g. fine fiber. This underflow is processed through a special separator designed to separate the glass from the fine fiber. One suitable commercially available separator for this purpose is the CONCENTRATOR previously noted.

The overflow from the first fine disk screen is separated in an air classifier into a light fraction and a heavy fraction. The light fraction is discharged onto a scalping disk screen which scalps out oversize pieces for re-shredding by either a secondary shredder or the primary shredder. The underflow from the scalping disk screen and the fiber from the CONCENTRATOR are combined to form a fuel fraction.

The heavy fraction from the air classifier is conveyed under a second magnetic separator to a consecutive assembly of a second fine disk screen, a medium disk screen, and a coarse disk screen, which perform essentially the same functions as the three disk screens of the apparatus of FIG. 1 which process the heavy fraction of its air classifier. The underflow from the second fine disk screen is processed through a second CONCENTRATOR to remove glass and fine fiber not previously removed. The fine fiber from the second CONCENTRATOR also becomes part of the fuel fraction.

Figure 4:
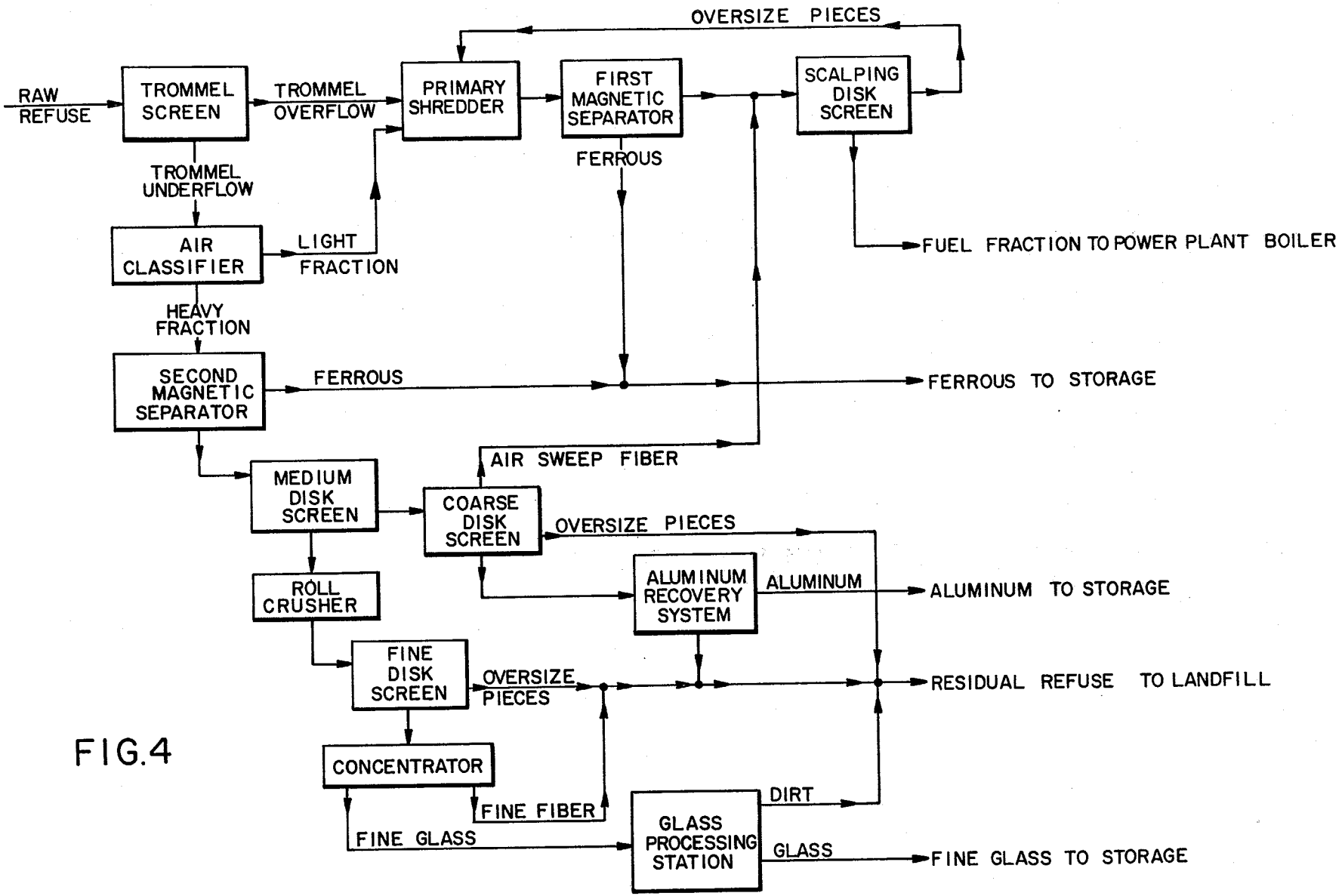
FIG. 4 is a functional block diagram illustrating a third embodiment of the present invention.

The Embodiment of FIG. 4

In the embodiment of FIG. 4 the raw refuse is first processed through a trommel screen, the underflow of which consists primarly of glass and cans with some loose fiber. The overflow of the trommel screen is primarily glass free. The trommel screen underflow may be discharged into an air classifier which separates the underflow into a light fraction and a heavy fraction. The trommel screen overflow and the light fraction from the air classifier are discharged into a primary shredder. Shredded refuse from the primary shredder is passed under a first magnetic separator and then discharged onto a scalping disk screen the underflow of which forms a fuel fraction. The overflow from the scalping disk screen is re-shredded by either a secondary shredder (not shown) or by the primary shredder.

The heavy fraction from the air classifier is passed under a second magnetic separator and then discharged onto a medium disk screen. The underflow from the medium disk screen is conveyed into a twin opposing roll crusher which reduces the larger pieces of glass and fiber into smaller pieces. The output from the roll crusher is discharged onto a fine disk screen, the underflow of which consists primarily of ground glass and other fine fibrous material. This underflow is processed through a CONCENTRATOR of the aforementioned type. Glass from the CONCENTRATOR is processed in a glass processing station.

The overflow from the medium disk screen is discharged onto a coarse disk screen. Air is forced upwardly through the coarse disk screen to separate large pieces of fibrous material which are conveyed to the scalping disk screen. The underflow from the coarse disk screen consists primarily of aluminum cans which are separated by an aluminum recovery system.

The overflow from the coarse disk screen, the overflow from the fine disk screen, the fiber from the CONCENTRATOR and the non-aluminum material from the aluminum recovery system are combined and are disposed of by using the same as landfill.

It is apparent that the present invention permits of modification in both arrangement and detail. The interface opening dimensions of the various disk screens in the various embodiments could be altered to accommodate variations in the composition and moisture content of the refuse. The locations and functions of the various disk screens and their combination with other conventional separating components could be altered in accordance with the teachings herein.

I claim:

1. In a refuse processing apparatus,
means for shredding the refuse into pieces;
a first disk screen for separating the shredded refuse into underflow and overflow, the overflow consisting of scalped-out oversize pieces of refuse which are larger than a predetermined maximum size and the underflow consisting of the remainder;
means for re-shredding the overflow from the first disk screen into pieces which are predominantly smaller than the predetermined maximum size;
a second disk screen for separating the underflow from the first disk screen into underflow and overflow, the underflow consisting primarily of ground glass and other fine material; and
means for combining the re-shredded overflow from the first disk screen with the overflow from the second disk screen.

2. The apparatus of claim 1 including an air classifier for separating the re-shredded overflow from the first disk screen and the overflow from the second disk screen into a light fraction and a heavy fraction.

3. The apparatus of claim 2 and further comprising disk screen means for separating the heavy fraction according to size.

4. The apparatus of claim 3 wherein the disk screen means has a plurality of rows of interleaved disks which convey shredded refuse from its infeed end to its discharge end, the spacing between adjacent disks at the infeed end being less than the spacing between adjacent disks at the discharge end.

5. The apparatus of claim 3 wherein the disk screen means includes a third disk screen for separating the heavy fraction into underflow and overflow, the underflow consisting primarily of ground glass and other fine material.

6. The apparatus of claim 5 wherein the disk screen means further includes a fourth disk screen for separating the overflow from the third disk screen into underflow and overflow, the underflow consisting primarily of heavy fibrous material.

7. The apparatus of claim 6 wherein the disk screen means further includes a fifth disk screen for separating the overflow from the fourth disk screen into underflow and overflow, the underflow including a large proportion of aluminum.

8. Apparatus for recovering fuel and other resources from solid municipal and industrial refuse comprising:
means for shredding the refuse into pieces;
first magnetic means for extracting a major portion of the ferrous metal from the shredded refuse;
a first disk screen for separating the remaining shredded refuse into underflow and overflow, the overflow consisting of pieces of refuse which are larger than a predetermined maximum size and the underflow consisting of the remainder;
means for re-shredding the overflow from the first disk screen into pieces which are predominantly smaller than the predetermined maximum size;
a second disk screen for separating the underflow from the first disk screen into underflow and overflow, the underflow consisting primarily of ground glass and other fine material;

an air classifier for separating the re-shredded overflow and the overflow from the second disk screen into a light fuel fraction consisting primarily of paper, plastic, and other light organic material and a heavy fraction consisting primarily of heavy inorganic material;

a cyclone for separating the light fraction from the air expelled from the air classifier;

second magnetic means for extracting substantially all of the remaining ferrous metal from the heavy fraction;

a third disk screen for separating the remaining heavy fraction into underflow and overflow, the underflow consisting primarily of ground glass and other fine material;

a fourth disk screen for separating the overflow from the third disk screen into underflow and overflow, the underflow consisting primarily of heavy fibrous material; and a fifth disk screen for separating the overflow from the fourth disk screen into underflow and overflow, the underflow including a large proportion of aluminum.

9. A method for recovering fuel and other resources from municipal and industrial refuse comprising the steps:

shredding the refuse into pieces of a range of sizes;

separating the shredded refuse into underflow and overflow by use of a first disk screen, the overflow consisting of oversize pieces of refuse which are larger than a predetermined maximum size;

re-shredding the overflow from the first disk screen into pieces which are predominantly smaller than the predetermined maximum size;

separating the underflow from the first disk screen into underflow and overflow by the use of a second disk screen, the underflow of the first disk screen consisting primarily of ground glass and other fine material;

combining the re-shredded overflow from the first disk screen with the overflow from the second disk screen.

10. The method of claim 9 including the step of separating the combined re-shredded overflow and overflow from the second disk screen by air classification into a light fraction and a heavy fraction.

11. The method of claim 10 including the step of further separating the heavy fraction according to size by use of a plurality of disk screens, each disk screen having a progressively increasing spacing between adjacent disks.

12. The method claim 11, including the step of separating the heavy fraction according to size by use of a disk screen.

13. A method for recovering fuel and other resources from solid municipal and industrial refuse which includes paper and other fibrous materials, non-fibrous organic materials, ferrous metal, aluminum, glass and other inorganic materials, comprising the steps:

shredding the refuse into pieces of a range of sizes;

extracting a major portion of the ferrous metal from the shredded refuse;

separating the remaining shredded refuse by use of a first disk screen into underflow and overflow, the overflow consisting of oversize pieces which are larger than a predetermined maximum size and the underflow consisting of the remainder;

re-shredding the oversize pieces into pieces which are predominantly smaller than the predetermined maximum size;

separating the underflow from the first disk screen by use of a second disk screen into underflow and overflow, the underflow consisting primarily of ground glass and other fine material and the overflow consisting of the remainder;

separating the re-shredded oversize pieces and the overflow from the second disk screen by air classification into a light fuel fraction consisting primarily of paper and other light organic material and a heavy fraction consisting primarily of heavy inorganic material;

extracting substantially all of the remaining ferrous metal from the heavy fraction;

separating the remaining heavy fraction by use of a third disk screen into underflow and overflow, the underflow consisting primarily of ground glass and other fine material;

separating the overflow from the third disk screen by use of a fourth disk screen into underflow and overflow, the underflow consisting primarily of heavy fibrous material; and separating the overflow from the fourth disk screen by use of a fifth disk screen into underflow and overflow, the underflow consisting primarily of aluminum.

14. Apparatus for recovering fuel and other resources from solid municipal and industrial refuse comprising:

means for shredding the refuse into pieces of a range of sizes;

first magnetic means for extracting a major portion of the ferrous metal from the shredded refuse;

a first fine disk screen for separating the remaining shredded refuse into underflow and overflow, the underflow consisting primarily of ground glass and fine fibrous material;

means for separating the underflow from the first fine disk screen into a first glass fraction and a first fiber fraction;

an air classifier for separating the overflow from the first fine disk screen into a light fraction consisting primarily of combustible organic material and a heavy fraction consisting primarily of metal, glass, and other inorganic material;

a scalping disk screen for separating the light fraction into underflow and overflow, the overflow consisting of pieces of refuse which are larger than a predetermined maximum size and the underflow consisting of the remainder;

means for re-shredding the overflow from the scalping disk screen into pieces which are predominantly smaller than the predetermined maximum size;

second magnetic means for extracting a major portion of the ferrous metal from the heavy fraction;

a second fine disk screen for separating the remaining heavy fraction into underflow and overflow, the underflow consisting primarily of ground glass and fine fibrous material;

a medium disk screen for separating the overflow from the second fine disk screen into underflow and overflow, the underflow consisting primarily of heavy fibrous material;

a coarse disk screen for separating the overflow from the medium disk screen into underflow and overflow, the underflow consisting primarily of aluminum; and means for separating the underflow from the second fine disk screen into a second glass fraction and a second fiber fraction;

whereby the underflow from the scalping disk screen, the first fiber fraction, and the second fiber fraction will be primarily combustible materials suitable for use as fuel.

15. Apparatus for recovering fuel and other resources from solid municipal and industrial refuse comprising:

a trommel screen for separating the refuse into underflow and overflow, the underflow consisting of pieces which are predominantly less than a first predetermined maximum size and the overflow consisting of the remaining refuse which is primarily combustible organic material;

an air classifier for separating the trommel screen underflow into a light fraction consisting primarily of combustible organic material and a heavy fraction consisting primarily of metal, glass and other inorganic material;

means for shredding the trommel screen overflow and the light fraction into pieces of a range of sizes;

first magnetic means for extracting a major portion of the ferrous metal from the shredded trommel screen overflow and shredded light fraction;

a scalping disk screen for separating the shredded trommel screen overflow and shredded light fraction into underflow and overflow, the overflow consisting of pieces of refuse which are larger than a second predetermined maximum size and the underflow consisting of the remainder;

means for re-shredding the overflow from the scalping disk screen into pieces which are predominantly smaller than the second predetermined maximum size;

second magnetic means for extracting a major portion of the ferrous metal from the heavy fraction;

a medium disk screen for separating the remaining heavy fraction into underflow and overflow;

a coarse disk screen for separating the overflow from the medium disk screen into underflow and overflow, the underflow consisting primarily of aluminum;

means for crushing the underflow from the medium disk screen;

a fine disk screen for separating the crushed underflow from the medium disk screen into underflow and overflow, the underflow consisting primarily of ground glass and fine fibrous material; and means for separating the underflow from the fine disk screen into a glass fraction and a fiber fraction;

whereby the underflow from the scalping disk screen, the light fraction from the air classifier, and the fiber fraction will be primarily combustible material suitable for use as fuel.

* * * * *